US011015544B2

(12) United States Patent
Musumeci et al.

(10) Patent No.: US 11,015,544 B2
(45) Date of Patent: May 25, 2021

(54) METHOD AND DEVICE FOR CONTROLLING AN INTERNAL COMBUSTION ENGINE OF AN AGRICULTURAL VEHICLE AND AGRICULTURAL VEHICLE COMPRISING THE DEVICE

(71) Applicant: FPT INDUSTRIAL S.P.A., Turin (IT)

(72) Inventors: Salvatore Musumeci, Turin (IT); Simon Porter, Baldissero Torinese (IT)

(73) Assignee: FPT INDUSTRIAL S.P.A., Turin (IT)

( * ) Notice: Subject to any disclaimer, the term of this patent is extended or adjusted under 35 U.S.C. 154(b) by 0 days.

(21) Appl. No.: 15/773,115

(22) PCT Filed: Nov. 11, 2016

(86) PCT No.: PCT/IB2016/056814
§ 371 (c)(1),
(2) Date: May 2, 2018

(87) PCT Pub. No.: WO2017/081658
PCT Pub. Date: May 18, 2017

(65) Prior Publication Data

US 2018/0320619 A1 Nov. 8, 2018

(30) Foreign Application Priority Data

Nov. 11, 2015 (IT) ..... 102015000071586

(51) Int. Cl.
*F02D 41/14* (2006.01)
*F02D 31/00* (2006.01)
(Continued)

(52) U.S. Cl.
CPC ..... *F02D 41/1497* (2013.01); *F02D 31/007* (2013.01); *F02D 41/2422* (2013.01);
(Continued)

(58) Field of Classification Search
CPC ..... F02D 41/1497; F02D 41/263; F02D 41/2422; F02D 31/007; F02D 2200/021;
(Continued)

(56) References Cited

U.S. PATENT DOCUMENTS 6,248,041 B1 6/2001 Den Besten
7,340,339 B1 * 3/2008 Fabry ..... B60K 28/16 477/3
(Continued)

FOREIGN PATENT DOCUMENTS

DE 102008036378 A1 * 2/2010 ..... A01D 41/1274
EP 1936154 6/2008
EP 2253822 11/2010

OTHER PUBLICATIONS

Patent Cooperation Treaty, International Search Report and Written Opinion for International Application No. PCT/IB2016/056814, dated Feb. 24, 2017, 11 pages.

*Primary Examiner* — George C Jin
(74) *Attorney, Agent, or Firm* — McCracken & Gillen LLC

(57) ABSTRACT

Method for controlling an internal combustion engine of an agricultural vehicle comprising the following steps, acquisition of a rated torque curve of said internal combustion engine, as a function of a rotation speed of said internal combustion engine, selection of a predefined speed value (PTS) of the internal combustion engine, introduction of a modified torque curve having torque values increased for speeds below said predefined speed value (PTS), switching from said rated torque curve to said modified torque curve when at least one operating condition has occurred.

15 Claims, 4 Drawing Sheets

(51) Int. Cl.
*F02D 41/24* (2006.01)
*F02D 41/26* (2006.01)

(52) U.S. Cl.
CPC ..... *F02D 41/263* (2013.01); *F02D 2200/021* (2013.01); *F02D 2200/0802* (2013.01); *F02D 2200/101* (2013.01); *F02D 2200/1002* (2013.01); *F02D 2200/602* (2013.01); *F02D 2250/18* (2013.01)

(58) Field of Classification Search
CPC ..... F02D 2200/602; F02D 2250/18; F02D 2200/101; F02D 2200/1002; F02D 2200/0802; F02D 31/001; F02D 31/04; D02D 41/1497; D02D 41/263
See application file for complete search history.

(56) References Cited

U.S. PATENT DOCUMENTS 7,628,015 B2 * 12/2009 Marumoto ..... F02B 33/34 60/607
8,897,943 B2 * 11/2014 Sheidler ..... A01D 41/12 701/22
2005/0065693 A1 * 3/2005 Wang ..... B60L 15/10 701/70
2005/0171669 A1 * 8/2005 Sato ..... B60W 30/188 701/51
2006/0207809 A1 * 9/2006 Casey ..... B60K 6/46 180/65.1
2007/0173375 A1 * 7/2007 Heber ..... B60W 10/02 477/170
2008/0146413 A1 * 6/2008 Iwatsuki ..... B60W 10/06 477/108
2010/0076662 A1 * 3/2010 Sheidler ..... A01D 41/127 701/102
2011/0100340 A1 * 5/2011 Mukkala ..... F02D 41/0007 123/564
2013/0035833 A1 * 2/2013 Nozu ..... B60K 17/35 701/69
2014/0123939 A1 * 5/2014 Bevan ..... F02B 39/04 123/337
2017/0298811 A1 * 10/2017 Santillo ..... F02B 37/12
2018/0238252 A1 * 8/2018 Nichelmann ..... F02D 41/0215
2019/0211771 A1 * 7/2019 Musumeci ..... F02D 31/007

* cited by examiner

METHOD AND DEVICE FOR CONTROLLING AN INTERNAL COMBUSTION ENGINE OF AN AGRICULTURAL VEHICLE AND AGRICULTURAL VEHICLE COMPRISING THE DEVICE

CROSS-REFERENCE TO RELATED APPLICATIONS

The present application claims priority to PCT International Application No. PCT/IB2016/056814 filed on Nov. 11, 2016, which application claims priority to Italian Patent Application No. 102015000071586 filed Nov. 11, 2015, the entirety of the disclosures of which are expressly incorporated herein by reference.

STATEMENT RE: FEDERALLY SPONSORED RESEARCH/DEVELOPMENT

Not Applicable

FIELD OF APPLICATION OF THE INVENTION

The present invention relates to the field of methods and devices for controlling internal combustion engines of agricultural vehicles. The invention also relates to an agricultural vehicle comprising said device.

THE STATE OF THE ART

Agricultural tractors in some operating conditions deliver power ranging between 90-100% of the maximum torque that the engine can deliver at that given rotation speed with ploughs or other similar devices that define the vast majority of the engine drag power applied to the vehicle.

This engine drag power is anything but constant depending on the random size and compactness of the soil clods.

Therefore, when a peak resistive load occasionally occurs, the engine can slow down or even stall. At that point the driver is forced to put the vehicle in neutral, restart the engine and try again.

The prior art has attempted to overcome this problem with the commercially available kick-to-neutral technique. This technique provides that when the engine drops below a predefined threshold of revolutions, the transmission will automatically shift to neutral, so as to disconnect the load from it and prevent the engine from stalling.

Although the issue is mitigated, it is certainly not resolved, since the vehicle's movement is still interrupted, even though it is not necessary to restart the engine.

The key advantage of kick-to-neutral is that the method is easy to implement and does not require particular computing efficiency.

SUMMARY OF THE INVENTION

The purpose of the present invention is to provide a method for controlling an internal combustion engine of an agricultural vehicle which makes it possible to reduce or eliminate stall conditions.

The technical solution presented can be implemented independently of kick-to-neutral, considerably reducing stall conditions, or in combination with kick-to-neutral, considerably reducing conditions in which the gearbox shifts into neutral.

In any case, vehicle standstills are reduced or eliminated.

The basic idea of the present invention is that of introducing and activating a rated torque curve modification, for rotation speeds below a predefined rotation speed (PTS) of the engine, when certain operating conditions occur.

This modified curve provides for an increase of the torque delivered by the engine for speeds less than this predetermined rotation speed.

The most important advantage is that the introduction of the modified curve does not require promptly recognition of a stall condition, allowing the engine to react without shutting itself down.

Said predefined engine rotation speed implicitly indicates a corresponding point of the rated torque curve. Such a rotation speed value preferably corresponds to a positive torque peak on the rated torque curve.

Modification of the torque curve preferably tends to smooth out the torque curve towards values similar to or higher than said peak.

According to a preferred variant of the invention, an operating condition that determines said switching corresponds with the fact that an accelerator pedal identifies an engine rotation speed greater than said predefined value (PTS) and at the same time that the engine rotation speed is greater than said predefined value (PTS).

According to another preferred variant of the invention which can be combined with the previous ones, said operating condition corresponds with the fact that an accelerator pedal stably identifies an engine rotation speed that is lower than said predefined value (PTS).

The accelerator pedal is considered stable when its position does not vary or varies within a defined range of positions in a predefined time interval.

A purpose of the present invention is to provide a method for controlling an internal combustion engine of an agricultural vehicle according to claim 1.

The present invention also relates to a control device for an internal combustion engine configured as described in the above-mentioned method and its variants.

Another purpose of the present invention is to provide an internal combustion engine comprising said control device.

A further purpose of the present invention is to provide an agricultural vehicle comprising said internal combustion engine.

The claims describe preferred variants of the invention, forming an integral part of the present description.

BRIEF DESCRIPTION OF THE FIGURES

Further purposes and benefits of the present invention will become apparent from the following detailed description of an example of an embodiment thereof (and of its variants) and from the accompanying drawings provided purely for non-limiting explanatory purpose, in which.

The same reference numbers and the same reference letters in the figures identify the same elements or components.

In the context of the present description the term "second" component does not imply the presence of a "first" component. These terms are used for clarity only and are not intended in a limiting way.

DETAILED DESCRIPTION OF EXAMPLES OF EMBODIMENT

Figure 1:
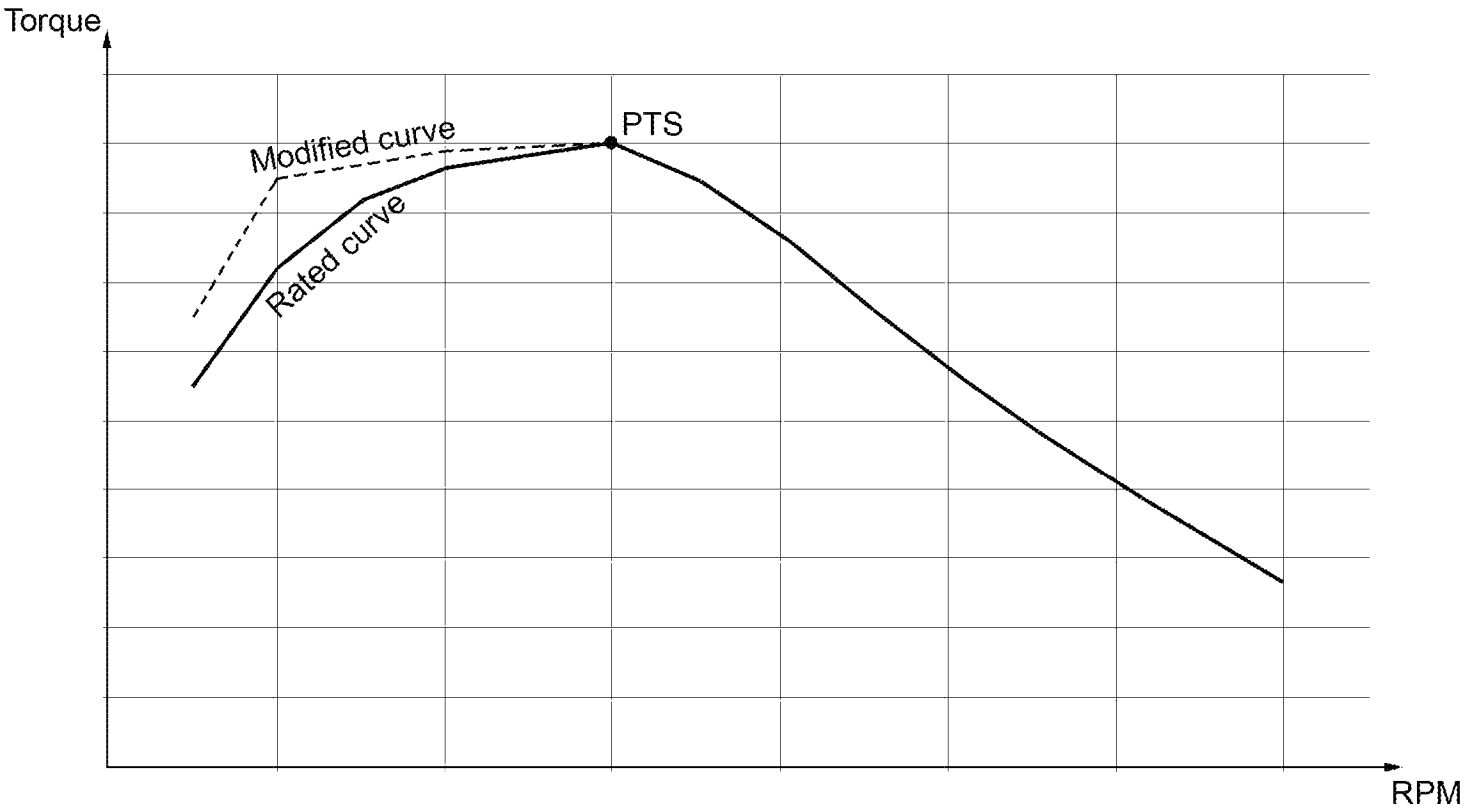
in FIG. 1 an example of a modified torque curve superimposed on an example of a rated torque curve is shown, in FIG. 2 an example of a diagram of the feedback control for the torque delivery of an engine of an agricultural vehicle is shown, in FIGS. 3 and 4, flow charts relating to the occurrence of two distinct operating conditions that determine a switching between the rated and modified torque curves shown in FIG. 1 are shown.

According to the present invention, in addition to the rated torque curve, shown in FIG. 1 by a solid line, a modified torque curve, indicated by a dashed line, is implemented. The graph of FIG. 1 expresses the values of maximum torque (N) delivered by the engine as a function of the speed or rotation speed of the engine (RPM).

It can clearly be seen from the figure that the modified curve intersects the rated curve at a point on the curve corresponding to a predefined speed value named PTS. The modified curve has higher torque values with respect to the rated curve for speeds less than the said predefined speed value PTS, while coinciding with the rated curve over which it is superimposed for speed values higher than the said PTS.

The point PTS identifies a speed value lower than the maximum speed of the engine. Therefore, as can be seen from FIG. 1, the torque curve remains completely unchanged from PTS up to the maximum speed value.

The value of the speed corresponding to PTS is included in a range delimited to the left by the value of the speed corresponding to the maximum torque value VTm delivered by the engine in accordance with the rated torque curve and to the right by a second value VT10% m which is lower than the value of the rated speed.

This second value is well away from the value of the rated speed, generally it may be about 10% greater than VTm. For example, if the maximum torque is obtained at 1800 rpm (VTm), then VT10% m is at 1980 rpm.

This second value is preferably well away from the rated engine speed because it is not desirable to change the rated power of the engine.

According to the present invention, switching from said rated torque curve to said modified torque curve happens when at least one operating condition has occurred.

This implies that, when the vehicle conditions cause the engine to run to the left of the PTS, depending on the load, more fuel may be injected than would be injected if the operating curve of the engine were the rated one.

It should be clear that whether the engine delivers the rated torque or the torque indicated by the modified curve is not only dependent on the engine speed being lower than the PTS. It in fact depends on the load applied to the engine.

According to a preferred variant of the invention, in agricultural vehicles, the accelerator pedal position does not generally indicate the value of torque delivered but rather the engine speed. The accelerator pedal position, depending on the gear selected, indicates the vehicle speed.

Figure 2:
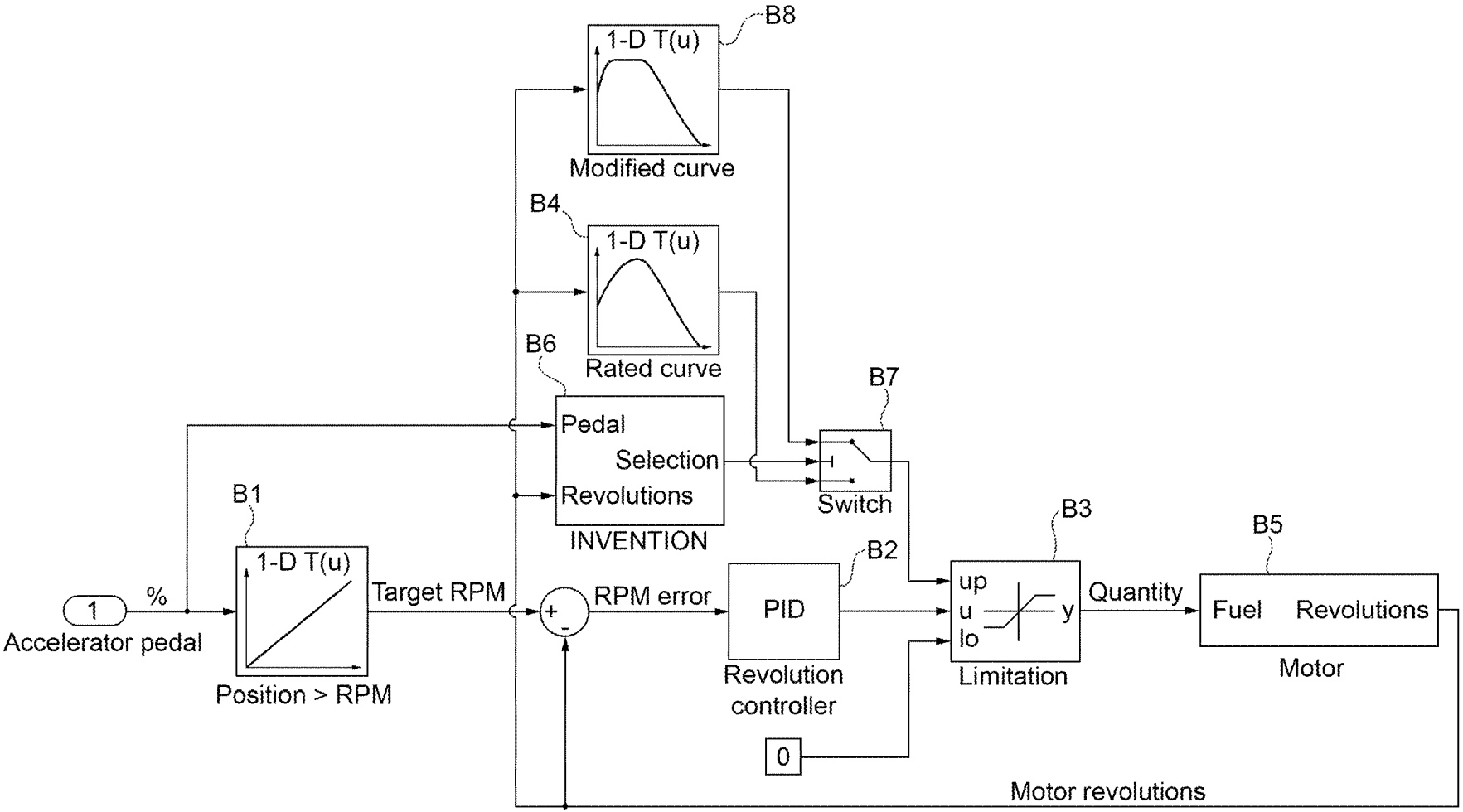

FIG. 2 shows a diagram of the feedback control, modified according to the present invention.

The input is the accelerator pedal position, the first block B1 converts the pedal position into a value of engine revolutions, so that a PID controller, block B2, known per se, generates a control signal consisting of a quantity of fuel/cycle, on the basis of an engine speed error.

The signal generated by the PID controller passes through a variable saturator, block B3, which has a second input that receives a signal generated from a look-up table, block B4, in which a rated torque curve is stored. In this way, the signalled amount of fuel/cycle is modulated in such a way that the maximum torque supplied by the engine is less than or equal to the one given by the rated torque curve. The final block farthest to the right in FIG. 2, block B5, represents the internal combustion engine with its fuel injection system and an rpm sensor is associated with the drive shaft to generate the feedback signal.

The diagram of FIG. 2, being different with respect to the prior art and therefore innovative, provides three additional blocks, A control block shown with a grey background, block B6, which has two inputs: engine speed and accelerator pedal position and A second look-up table, block B8, in which a modified torque curve is stored and A switching block B7 that makes it possible to switch between the rated torque curve look-up table, block B4, and the modified torque curve look-up table, block B8, based on input generated by said control block B6.

The output of this command block intervenes, substantially, on the choice of the fuel restriction curve generated by the saturator B3, in such a way as to modify the restriction imposed on the fuel injection control signal so as to implement the strategy which is the purpose of the present invention.

According to a first preferred variant of the invention, an operating condition that determines the activation of the modified torque curve is represented by the fact that the accelerator pedal identifies an engine rotation speed greater than said predefined value PTS AND an engine rotation speed that is greater than said predefined value (PTS).

It is therefore evident that if the operating condition of the engine is to the right of PTS, the modified torque curve is automatically enabled.

In the event of a sudden and significant load, the previous operating point of the engine moves vertically up until it intercepts the rated torque curve, then moves to the left to lower speed values. Continuing to reduce the rotation speed, the working point exceeds the torque point corresponding to the PTS, moving onto the modified torque curve, therefore delivering a torque greater than the rated torque, as defined by the modified torque curve.

It is readily understood that it is not necessary to recognise a stall condition in order to promptly react, since the modified torque curve is adopted independently of a stall condition, i.e. by the occurrence of the aforementioned conditions. Adoption/activation of the modified torque curve generally takes place long before the stall occurs without actually changing the engine performance, as long as, specifically, the load does not exceed the rated torque which, in the absence of this strategy, would have caused the engine to stall.

Figure 3:
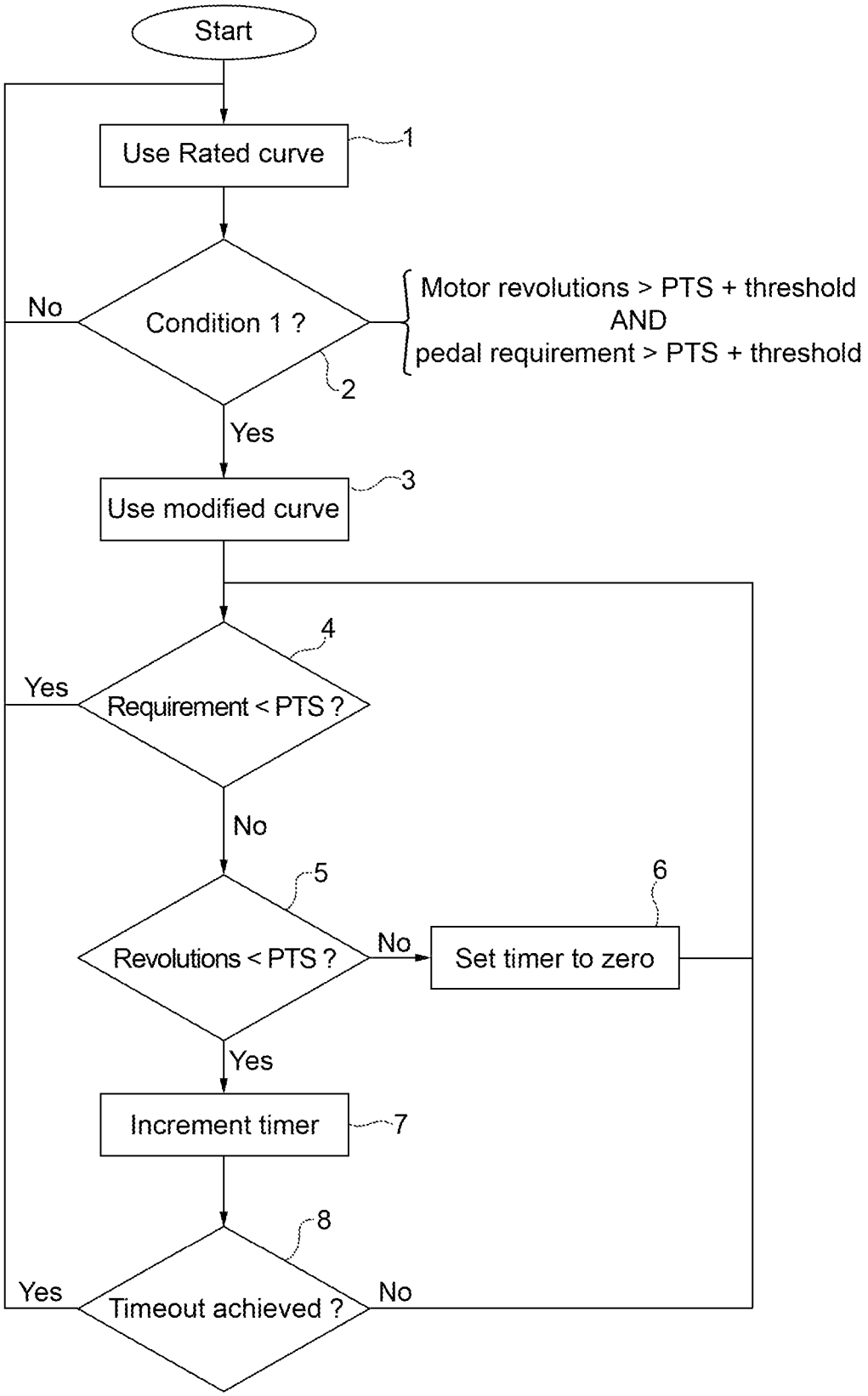

FIG. 3 shows a preferred embodiment of the variant described here:

Step 1: activation of the rated torque curve,

Step 2: check if engine speed>PTS AND pedal position>PTS, then, if so (Step 1: YES)

Step 3: activation of the modified torque curve, otherwise, (Step 2: NO) return to Step 1, then Step 4: check if the accelerator pedal engine revolutions requirement is lower than PTS, if so (Step 4: YES) return to beginning (Step 1) otherwise (Step 4: NO), Step 5: check if engine revolutions are lower than PTS, if not (Step 5: NO)

Step 6: setting to zero of a timer and return to Step 4, otherwise (Step 5: YES)

Step 7: the increment of said timer which counts a continuous time of use of the modified torque curve, then Step 8: check if this time is greater than a predefined value, if so (Step 8: YES), return to Step 1, otherwise, return to Step 3.

According to another preferred variant of the present invention the modified torque curve is adopted when the accelerator pedal stably identifies an engine rotation speed lower than said predefined value PTS.

This preferred variant of the invention is extremely beneficial in conditions in which the vehicle cannot move at a speed such as to allow the engine to exceed the PTS.

According to a preferred variant of the present invention that may be combined with any of the preceding and/or following variants in the present description, the engine is turbocharged by means of at least one turbocharger. A device is installed in the engine air intake which is capable of controlling an angle of incidence of the flow of fresh air onto the compressor blades. This makes it possible to vary the performance and flow rate of the compressor and to obtain a very fast dynamic response thereof.

When the operating point of the engine moves beyond the rated torque curve and to the left of the PTS, then these means of controlling the angle of incidence of the flow of air are adjusted so as to increase the flow rate of air entering the engine. This makes it possible to burn the extra fuel injected in the presence of more oxygen in the combustion chamber, thus obtaining a better dynamic response of the engine as well as further benefits for the exhaust gas treatment systems which will be discussed below.

The value PTS preferably coincides with the maximum value of the torque delivered by the engine in accordance with the rated torque curve.

It is further understood that when the engine operates to the left of the PTS, in the case of a significant resistive load, the rated torque curve does not guarantee to find a working point in equilibrium, with the consequent stalling of the engine. Thanks to the present invention, this problem is also resolved.

Figure 4:
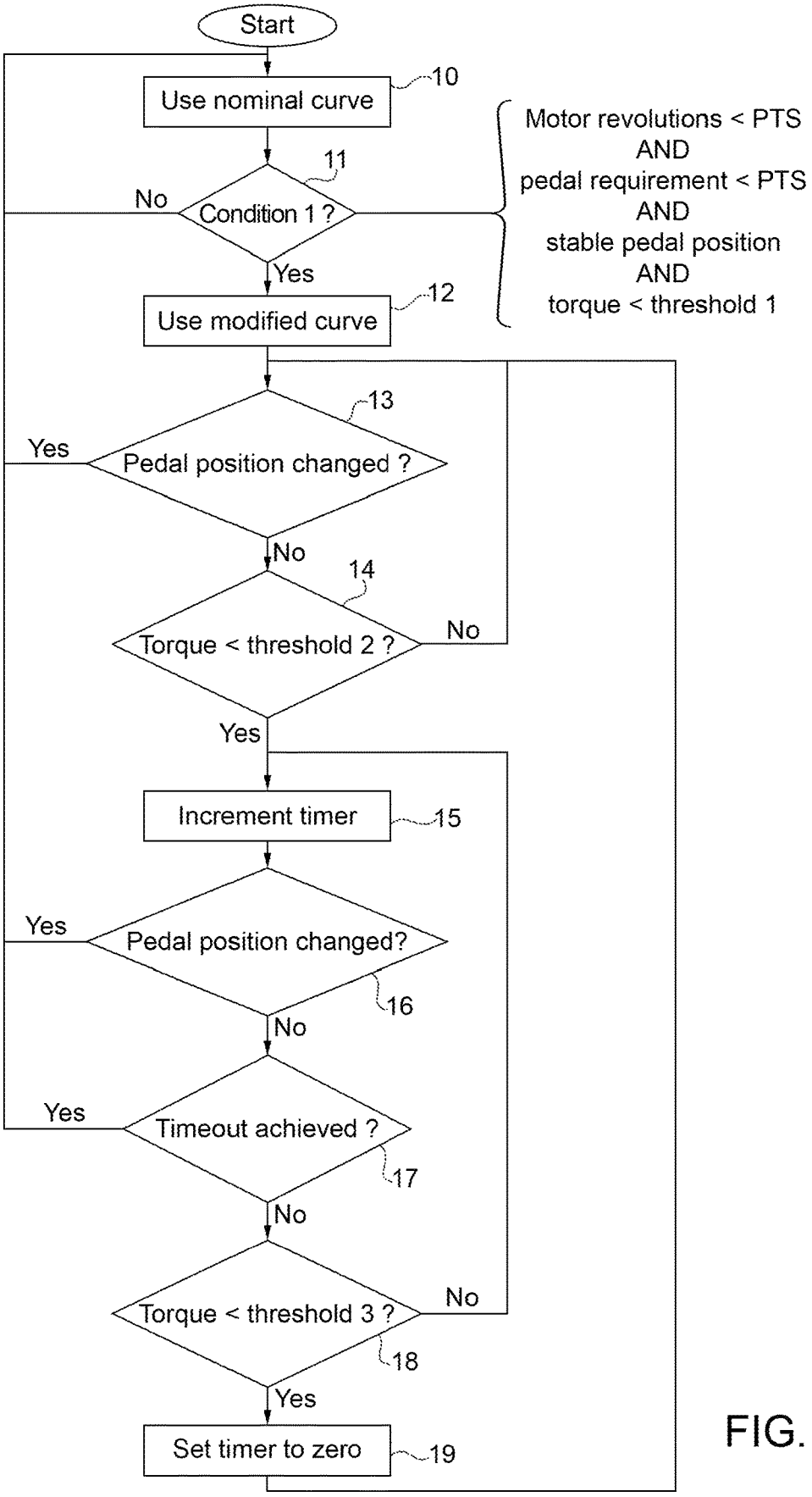

FIG. 4 shows a preferred implementation of the present second variant:

Step 10: activation of the rated torque curve,

Step 11: check if engine revolutions are <PTS AND pedal position indicates revolutions<PTS AND pedal position is considered stable AND the torque delivered is lower than a first predefined threshold S1 (rpm) then (Step 11: YES)

Step 12: activation of modified torque curve, otherwise, (Step 11: NO) return to Step 10, then Step 13: check if pedal position has changed, if so (Step 13: YES) then return to Step 10, otherwise (Step 13: NO)

Step 14: check if torque delivered is higher than a second threshold S2 (rpm), typically higher than said first threshold S1, if not (Step 14: NO) then return to Step 13, otherwise (Step 14: YES)

Step 15: a time counter is incremented, then

Step 16: check if pedal position has changed, if so (Step 16: YES) then return to Step 10, otherwise (Step 16: NO)

Step 17: check if counter has reached a predefined time value: if so (Step 17: YES) then return to Step 10, otherwise (Step 17: NO) then Step 18: check if torque delivered is lower than a third threshold S3 (rpm) lower than or equal to said second threshold (threshold 2), if not (Step 18: NO) then return to Step 15, otherwise (Step 18: YES)

Step 19: setting to zero of the time counter and return to Step 11.

The threshold S1 (rpm) is preferably equal to 90% of the value of the rated torque at that given speed of rotation.

The threshold S2 (rpm) is used to identify the delivery of a torque close to the rated torque at that given rotation speed. It is preferably equal to about 99% of the rated torque at that particular rotation speed.

The third threshold S3 (rpm) is used to identify the end of the peak load. An indicative value may be 95% of the rated torque at that particular rotation speed.

For the practical implementation of one or both of the variants described above it is preferable to compare the engine speed or the pedal position not only with PTS, but also with PTS+delta, in order to make the present control strategy more stable.

The methods represented by means of the flow charts of FIGS. 3 and 4 are preferably carried out continuously and in parallel, or alternatively using one or the other.

According to any one of the preceding variants, when the engine delivers a torque greater than the rated torque thanks to the adoption of the modified torque curve, an incremental time counter is preferably activated which leads to restoration of the rated torque curve when the counter reaches a predetermined limit value. This restoration guarantees a delivery of extra torque which is time-limited in order not to damage the internal combustion engine.

According to a variant of the control strategy, when the torque delivered by the engine is greater than that provided by the rated torque curve, or in general when necessary for exhaust gas treatment systems, it is possible to divert part of the compressed air from the compressor directly to the engine exhaust, preferably in the section upstream of one of the turbines present or alternatively downstream of the last turbine, so as to promote cooling of the exhaust gas treatment system. An example of this implementation is given in FR3024178, with the difference that it is not necessary to subdivide the gas exhausted from the engine before it enters the turbine (dual-inlet turbine), nor is it necessarily a requirement to subdivide the exhaust manifolds.

If the intake line is also provided with means for regulating the flow of compressed air from the compressor, for example by means of control of the angle of incidence of fresh air onto the blades of the compressor, then it is beneficially possible to adjust the flow of compressed air from the compressor, taking into account the flow of compressed air needed to cool the exhaust treatment systems.

Another process, parallel to the previous ones, monitors various engine operating parameters, including engine oil pressure, engine oil temperature and/or coolant temperature, temperature of post-treatment exhaust gases (ATS) and pressures in the engine intake and outlet. In the event of a fault and/or suspected failure of the engine this process inhibits the adoption/activation of the modified torque curve.

The monitoring of possible engine failures is known per se. The monitoring of engine operating conditions for other purposes is also known per se. Appropriate temperature and pressure thresholds may therefore be adopted.

For example, activation of the modified torque curve may be suppressed when the temperature of the engine, engine oil and/or liquid refrigerant is above a first threshold or below a second threshold which is lower than the first threshold.

The present invention therefore relates not only to a method, but also to an engine control unit (ECU) implementing the present invention and also relates to an internal combustion engine, preferably a diesel cycle engine, controlled by said engine control unit.

The present invention also relates to an agricultural vehicle driven by such an internal combustion engine.

The present invention can be beneficially implemented by a computer program comprising coding means for performing one or more steps of the method, when this program is run on a computer. It is therefore intended that the scope of protection extends to said computer program and also to computer readable media that comprise a recorded message, such computer-readable media comprising coding means for performing one or more steps of the method when said program is run on a computer.

From the above description, a person skilled in the art is able to achieve the purpose of the invention without introducing any further design specifications. The elements and characteristics illustrated in the various preferred embodiments, including the drawings, can be combined without thereby departing from the scope of protection of the present patent application. The description contained in the section on the state of the art is only intended to provide a better understanding of the invention and does not represent a statement of existence as described. Moreover, if not specifically excluded in the detailed description, as described in the section on the state of the art it can be considered in combination with the characteristics of the present invention, forming an integral part of the present invention. None of the characteristics of the different variants is therefore essential, the individual characteristics of each preferred variant or drawing can be individually combined with the other variants described.

The invention claimed is:

1. A method for controlling an internal combustion engine of an agricultural vehicle comprising the following steps, acquisition of a rated torque curve of said internal combustion engine, as a function of a rotation speed of said internal combustion engine, selection of a predefined speed value (PTS) of the internal combustion engine, introduction of a modified torque curve having torque values increased with respect to the rated curve for speeds below said predefined speed value (PTS), and unchanged torque values for speeds greater than said predefined speed value, switching from said rated torque curve to said modified torque curve on a sufficient condition that an operating condition has occurred, wherein said operating condition coincides with at least one of the following:

(i) an accelerator pedal identifies a rotation speed of the engine higher than said predefined value (PTS) AND a rotation speed of the engine is higher than said predefined value (PTS), or (ii) an accelerator pedal stably identifies a rotation speed of the engine lower than said predefined value (PTS) AND a rotation speed of the engine is lower than said predefined value (PTS).

2. A method according to claim 1, wherein when the internal combustion engine delivers a torque higher than said rated torque, an incremental counter is activated which, when it reaches a predefined value, restores said rated torque curve.

3. A method according to claim 1, further comprising a step of monitoring a temperature of the internal combustion engine and/or of a related device for post-treatment of the exhaust gases (ATS), and a step of restoring said rated torque curve when said temperature exceeds a predefined threshold.

4. A method according to claim 1, wherein said modified torque curve is obtained by altering a fuel injection limitation curve.

5. A method according to claim 1, wherein said predefined speed value (PTS) of the internal combustion engine coincides with a positive peak of said rated torque curve.

6. A method according to claim 1 comprising the following steps:

(Step 1) Activation of rated torque curve, (Step 2) check if engine speed>PTS AND pedal position>PTS, then, if so (Step 1: YES)

(Step 3) activation of modified torque curve, otherwise (Step 2: NO) return to beginning (Step 1), then (Step 4) check if accelerator pedal revolutions requirement is lower than PTS, if so (Step 4: YES) return to beginning (Step 1) otherwise (Step 4: NO), (Step 5) check if engine revolutions are lower than PTS, if not (Step 5: NO)

(Step 6) setting a timer to zero and return to check if accelerator pedal revolutions requirement is lower than PTS (Step 4), otherwise (Step 5: YES)

(Step 7) Increment of said timer which counts a continuous utilisation time of the modified torque curve, then (Step 8) check if this time is greater than a predefined value, if so (Step 8: YES), return to Step 1, otherwise, return to activation of modified torque curve (Step 3).

7. A method according to claim 1 comprising the following steps:

(Step 10) Activation of rated torque curve, (Step 11) check if engine revolutions are <PTS AND pedal position indicates revolutions<PTS AND pedal position is considered stable AND the torque delivered is lower than a first predefined threshold S1 (rpm) then (Step 11: YES)

(Step 12) activation of modified torque curve, otherwise, (Step 11: NO) return to Step 10, then (Step 13) check if pedal position has changed, if so (Step 13: YES) then return to beginning (Step 10), otherwise (Step 13: NO)

(Step 14) check if torque delivered is higher than a second threshold S2 (rpm), higher than said first threshold S1, if not (Step 14: NO) return to check if pedal position has changed (Step 13), otherwise (Step 14: YES)

(Step 15) increment of a time counter, then (Step 16) check if pedal position has changed, if so (Step 16: YES) then return to beginning (Step 10), otherwise (Step 16: NO)

(Step 17) check if counter has reached a predefined time value: if so (Step 17: YES) return to beginning (Step 10), otherwise (Step 17: NO)

(Step 18) check if torque delivered is lower than a third threshold S3 (rpm) lower than or equal to said second threshold (threshold 2), if not (Step 18: NO) return to increment of time counter (Step 15), otherwise (Step 18: YES)

(Step 19) setting a timer to zero and return to step of checking if the engine revolutions are <PTS AND pedal position indicates revolutions<PTS AND pedal position is considered stable AND torque delivered is lower than a first predefined threshold S1 (rpm) (Step 11).

8. A device for controlling an internal combustion engine of an agricultural vehicle comprising processing means configured to control a fuel injection into said internal combustion engine and configured to carry out all the steps of claim 1.

9. An internal combustion engine comprising a device for controlling an internal combustion engine of an agricultural vehicle according to claim 8.

10. An agricultural vehicle comprising an internal combustion engine according to claim 9.

11. A method according to claim 1, wherein the modified torque curve has at least one portion that increases with increasing speed whose torque values are increased with respect to the rated curve for speeds below said predefined speed value (PTS).

12. A method for controlling an internal combustion engine of an agricultural vehicle comprising the following steps, acquisition of a rated torque curve of said internal combustion engine, as a function of a rotation speed of said internal combustion engine, selection of a predefined speed value (PTS) of the internal combustion engine, introduction of a modified torque curve having torque values increased with respect to the rated curve for speeds below said predefined speed value (PTS), and unchanged torque values for speeds greater than said predefined speed value, switching from said rated torque curve to said modified torque curve on a sufficient condition that an operating condition has occurred, wherein said operating condition coincides with the following:

an accelerator pedal identifies a rotation speed of the engine higher than said predefined value (PTS) AND a rotation speed of the engine is higher than said predefined value (PTS).

13. A method according to claim 12, wherein the modified torque curve has at least one portion that increases with increasing speed whose torque values are increased with respect to the rated curve for speeds below said predefined speed value (PTS).

14. A method for controlling an internal combustion engine of an agricultural vehicle comprising the following steps, acquisition of a rated torque curve of said internal combustion engine, as a function of a rotation speed of said internal combustion engine, selection of a predefined speed value (PTS) of the internal combustion engine, introduction of a modified torque curve having torque values increased with respect to the rated curve for speeds below said predefined speed value (PTS), and unchanged torque values for speeds greater than said predefined speed value, switching from said rated torque curve to said modified torque curve on a sufficient condition that an operating condition has occurred, wherein said operating condition coincides with the following:

an accelerator pedal stably identifies a rotation speed of the engine lower than said predefined value (PTS) AND a rotation speed of the engine is lower than said predefined value (PTS).

15. A method according to claim 14, wherein the modified torque curve has at least one portion that increases with increasing speed whose torque values are increased with respect to the rated curve for speeds below said predefined speed value (PTS).

* * * * *